US005570943A

United States Patent [19]

Schröder et al.

[11] Patent Number: 5,570,943

[45] Date of Patent: Nov. 5, 1996

[54] TRACK ASSEMBLY FOR A DRAWER

[75] Inventors: Gerhard Schröder, Bad Oeynhausen; Frank Noske, Minden; Gordon Rush, Lemgo, all of Germany

[73] Assignee: Paul Hettich GmbH & Co., Kirchlengern, Germany

[21] Appl. No.: 367,213

[22] PCT Filed: Apr. 26, 1994

[86] PCT No.: PCT/DE94/00473

§ 371 Date: Jan. 9, 1995

§ 102(e) Date: Jan. 9, 1995

[87] PCT Pub. No.: WO94/26146

PCT Pub. Date: Nov. 24, 1994

[30] Foreign Application Priority Data

May 12, 1993 [DE] Germany ..... 9307088 U

[51] Int. Cl.[6] ..... A47B 88/04

[52] U.S. Cl. ..... 312/334.11; 312/334.13; 312/334.37

[58] Field of Search ..... 312/334.11, 334.13, 312/334.15, 334.26, 334.25, 334.33, 334.37, 334.9; 384/18, 19

[56] References Cited

U.S. PATENT DOCUMENTS

| | | | |
|---|---|---|---|
| 3,203,749 | 8/1965 | Bullock et al. | 384/18 |
| 3,901,564 | 8/1975 | Armstrong | 384/18 |
| 4,662,761 | 5/1987 | Hoffman | 384/18 |
| 4,752,142 | 6/1988 | Jackson et al. | 384/18 |
| 5,344,228 | 9/1994 | Kovarik et al. | 312/334.9 |

FOREIGN PATENT DOCUMENTS

| | | | |
|---|---|---|---|
| 659534 | 10/1951 | United Kingdom | 384/18 |

*Primary Examiner*—Milton Nelson, Jr.
*Assistant Examiner*—Hanh V. Tran
*Attorney, Agent, or Firm*—Henry M. Feiereisen

[57] ABSTRACT

A track assembly for a drawer includes a guide rail securable to a piece of furniture, a pull-out rail securable to a drawer, and an inner section rail for connecting the guide rail with the pull-out rail. The guide and the pull-out rails are each formed of substantially L-shaped configuration and exhibit extreme edges that are turned inwardly to form three inner curved corner areas for receiving a set of three balls interposed between outer surfaces of the inner section rail and the inner surfaces of the guide rail and the pull-out rail and positioned such as to define corners of a rectangular triangle.

6 Claims, 2 Drawing Sheets

TRACK ASSEMBLY FOR A DRAWER

Figure 1:
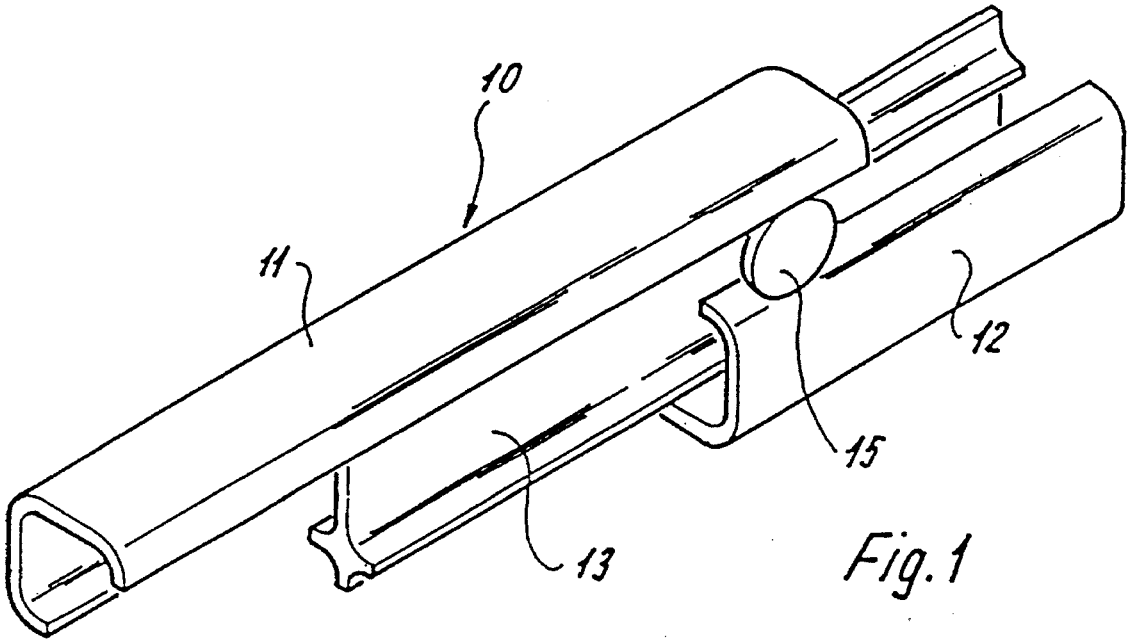

The present invention refers to a track assembly for a drawer, including a guide rail securable to the body of a piece of furniture and a pull-out rail attached to a drawer, as well as an inner section rail provided with several ball bearings and connecting the guide rail with the pull-out rail, with the balls capable of rolling in sets between both outer surfaces of the inner section rail and the inner surfaces of the guide rail and the pull-out rail.

In a conventional track, assembly the pull-out rail which is attached to the drawer is made of a square pipe with rounded corners. The guide rail which is attached to the body of the piece of furniture is situated within the interior space of the pull-out rail and is massive. The sets of balls roll on the inside corners of the pull-out rails. The balls are retained via a cage.

This generally reliable construction is, however, material intensive and relatively heavy because of the massive guide rail.

The present invention is based on the object to provide a track assembly of the above-described type such that it can be produced in a material-saving way and thus of reduced weight. Moreover, it should be producible more cost-efficient.

This object is attained by forming the guide rail and the pull-out rail of angular cross section, with both free edge areas, which face away, extending each in form of an inwardly directed arc for formation of ball bearings so that three balls respectively form a set of balls.

The embodiment according to the invention creates a number of advantages. It is possible to align the guide rail relative to the pull-out rail such that they overlap complementary to each other to greatly reduce the structural height. This results in significant advantages when being mounted onto many pieces of furniture. When the height of the track should be kept the same, as in designs known per se, balls of greater diameter could be used so that the track can be subjected to increased loads. The need for material for the rails is greatly reduced when considering that nearly two balls are omitted. Since the number of used balls is reduced, the costs are even further lowered. In accordance with the standard embodiment, three balls are arranged on each side of the inner section rail, i.e. with respect to the vertical center plane of the track exactly the same number of balls is placed on one side of the upper area as on the opposing side of the lower area and vice versa. In such an arrangement, an overlap of the pull-out rail with the guide rail is then also possible. In the tracks at hand, the unavoidable slippage between the rails and the balls will result in the course of time that the drawer cannot be completely withdrawn from the body of the piece of furniture, unless an increased force is applied. In order to eliminate this drawback, it is further provided in accordance with a further feature to mount the pull-out rail relative to the guide rail such that no overlap exists so that the same number of balls is arranged on one side of the upper area of the inner section rail as on the same side of the lower area. This means that two balls roll on each side of the upper and lower areas and only one ball on the other side. Thus, a slot is formed of a height which is slightly smaller than the height of the inner section rail. This affords the possibility to have one or more synchronizing rolls to roll in this slot to enable always a full withdrawal of the drawer.

Figure 2:
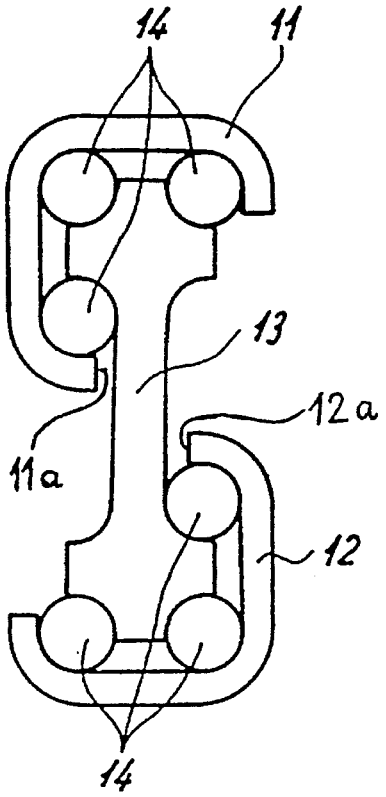
Figure 3:
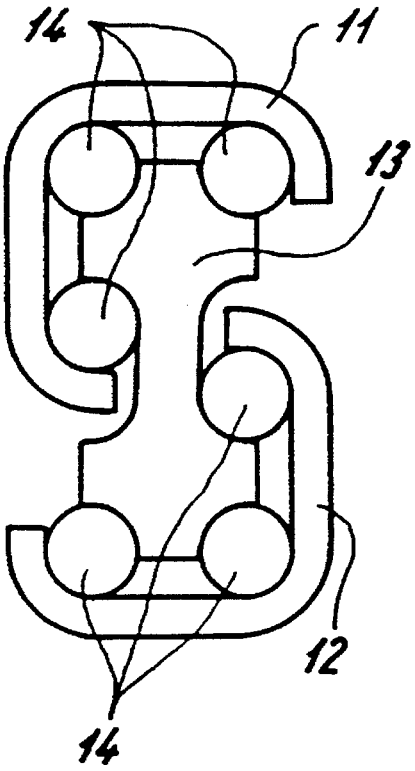
Figure 4:
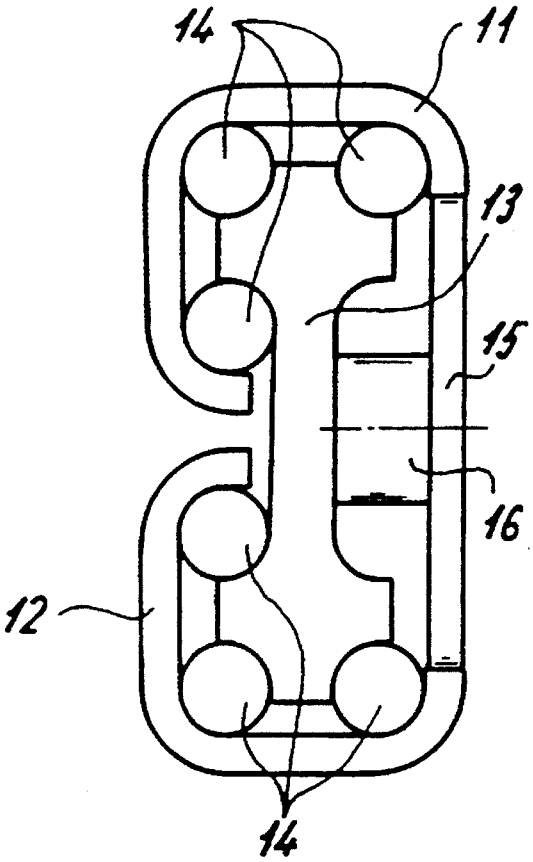

Preferred exemplified embodiments of the invention will now be described in more detail with reference to the attached drawings, in which FIG. 1 shows a perspective illustration of the track according to the invention, FIGS. 2–4 are respective end views of various assembling possibilities.

The track 10 illustrated in FIG. I includes a pull-out rail 11 which is secured to a not shown drawer, a stationary guide rail 12 secured to a not shown body of a piece of furniture, an inner section rail 13 as well as balls 14 not shown in FIG. 1, and a synchronizing roll 15. As shown in the FIGURES, the functions of the rails of same structure can also be exchanged when mounting them accordingly. FIGS. 2–4 show that the pull-out rail 11 and the guide rail 12 are of angular substantially L-shaped configuration, with the corner being rounded to form a ball bearing. The outer free edge areas extend respectively in form of inwardly directed arcs or corner areas so as to also form ball bearings. The FIGURES show that the inner section rail is especially narrow to attain a particularly precise guidance to which the lateral stability can be attributed. In the embodiment according to FIG. 2, the pull-out rail 11 and the guide rail 12 which are turned inwardly to face one another. exhibit extreme edges 11*a* and 12*a*, respectively, extend at a distance to each other. The pull-out rail 11 and the guide rail 12 are mounted in inverted manner to each other so that two balls roll in the upper area of the inner section rail 13 on the left side and also two balls 14 roll in the lower area on the right side. The track 10 can thus be characterized as asymmetric with respect to the vertical and the horizontal center axis.

In the track according to FIG. 3, the overall height is reduced since the inner section rail 13 has a significantly smaller height. The cross sections of the pull-out rail 11 and the guide rail 12 are again the same to thereby result in an overlap. In the embodiment according to FIG. 4, the pull-out rail 11 and the guide rail 12 are assembled in such a manner that the inwardly directed arcs of both rails are slightly spaced from each other on one side. On this side, two balls are respectively supported on the left side in the upper and lower areas while on the other side, only one ball is always supported. This results in the formation of a longitudinal slot of a height which is slightly smaller than the height of the inner section rail 13. The synchronizing roll 15 acting as friction roll is supported by a bolt or pin 16 which is secured to the inner section rail 13. The FIGURES show that each track can be equipped with several synchronizing rolls 15. The embodiment illustrated in FIG. 4 is symmetric with respect to the horizontal center plane. The embodiment according to FIG. 2 can also be equipped with synchronizing rolls if one of the inwardly directed arcs is sharp-edged on the outside. Moreover, the embodiments according to FIGS. 2 and 4 offer the possibility that the synchronizing rolls can be substituted in the longitudinal slot by a draw-in unit in form of a conventional mechanism by which the drawer is loaded to seek its closing position.

We claim:

1. A track assembly for a drawer, comprising:

a guide rail securable to a body of a piece of furniture;

a pull-out rail securable to a drawer; and an inner section rail for connecting the guide rail with the pull-out rail, each one of said guide and pull-out rails being formed of substantially L-shaped configuration and exhibiting extreme edges that are turned inwardly to form three inner curved corner areas for receiving a set of three balls interposed between outer surfaces of the inner section rail and the inner surfaces of the guide rail and the pull-out rail and positioned such as to define corners of a rectangular triangle.

2. The track assembly of claim, 1 wherein the pull-out rail and the guide rail are of same cross section.

3. The track assembly of claim, 1 wherein the pull-out rail and the guide rail are positioned such that one of the inwardly turned edges of the pull-out rail overlaps one of the inwardly turned edges of the guide rail.

4. The track assembly of claim 1 wherein the inner section rail has an upper portion and a lower portion, with a same number of balls being arranged on one side of the upper portion of the inner section rail as on an opposing side of the lower portion of the inner section rail.

5. The track assembly of claim 1 wherein the inner section rail has an upper portion and a lower portion, with a same number of balls being arranged on one side of the upper portion of the inner section rail as on a same side of the lower portion of the inner section rail.

6. The track assembly of claim.1, further comprising at least one synchronizing roll which is placed in a slot defined by the pull-out rail and the guide rail and rolls upon a bolt secured to the inner section rail.

* * * * *